US005099657A

United States Patent [19]

Huang

[11] Patent Number: 5,099,657

[45] Date of Patent: Mar. 31, 1992

[54] STRUCTURE OF COOLING TANK FOR WATER COOLER

[76] Inventor: Chia-Tsai Huang, No. 4, Alley 75, Lane 50, Wu Feng Rd., Pan Chiao, Taipei Hsien, Taiwan

[21] Appl. No.: 639,202

[22] Filed: Jan. 9, 1991

[51] Int. Cl.[5] ..... F25D 17/02

[52] U.S. Cl. ..... 62/431; 62/434

[58] Field of Search ..... 62/431, 434, 435, 430

[56] References Cited

U.S. PATENT DOCUMENTS

| | | | |
|---|---|---|---|
| 1,836,073 | 12/1931 | Hull | 62/434 X |
| 1,912,577 | 6/1933 | Glass | 62/435 X |
| 1,969,187 | 8/1934 | Schutt | 62/59 X |
| 2,722,108 | 11/1955 | Hailey | 62/434 X |
| 2,779,171 | 1/1957 | Lindenblad | 62/435 |
| 3,216,215 | 11/1965 | Schuett | 62/431 X |
| 3,247,678 | 4/1966 | Mohlman | 62/434 X |

FOREIGN PATENT DOCUMENTS

| | | | |
|---|---|---|---|
| 3449 | 8/1926 | Australia | 62/434 |

*Primary Examiner*—William E. Tapoical

*Attorney, Agent, or Firm*—Fleit, Jacobson, Cohn, Price, Holman & Stern

[57] ABSTRACT

A cooling tank for a water cooler, comprising a housing for holding water, having set therein a condensing coil which is uniformly arranged around the inner wall surface of said housing with one end connected to the expansion valve of said water cooler and an opposite end connected to the compressor of said water cooler for circulation of cooling medium, and a plurality of coil-shaped water pipes which are separately mounted in said housing with each two opposite ends respectively connected to an independent inlet valve and an independent outlet valve mounted on said housing at the outside. A plurality of reservoirs are separately connected to the inlet and outlet valves of each coil-shaped water pipes so that the liquid from each reservoir can be separately pumped into the coil-shaped water pipes for circulation through the cooling tank for cooling.

1 Claim, 3 Drawing Sheets

STRUCTURE OF COOLING TANK FOR WATER COOLER

BACKGROUND OF THE INVENTION

The present invention relates to cooling tanks, and more particularly relates to a cooling tank for a water cooler for cooling liquid from separate water reservoirs at the same time.

FIG. 1 illustrates a water cooling system according to the prior art, in which cooling water is pumped from a cooling water tower 2 for circulation through a water coooler 1 to absorb the heat from the cooling medium which circulates in a condensing coil 8 inside a cooling tank 5' set in said water cooler 1 to make heat exchange with the water pumped from a water reservoir 6 for circulation through said cooling tank 5'. Disadvantage of this structure of water cooling system is that the water cooler can only be used for cooling the liquid from a reservoir. For cooling different liquid from two or more water reservoirs, two or more condensing coils must be separately installed inside a water cooler or two or more water coolers must be simultaneously used. It is very expensive and difficult to install several condensing coils in a water cooler or several water coolers in a water cooling system.

SUMMARY OF THE INVENTION

The present invention has been accomplished under the circumstances in view. It is therefore the main object of the present invention to provide a water cooling tank for a water cooler which can be conveniently alternatively controlled to simultaneously cool down different liquid from separate reservoirs.

It is another object of the present invention to provide a water cooling tank for a water cooler which is inexpensive to manufacture.

According to the present invention, there is provided a cooling tank for a water cooler which is generally comprised of a housing for holding water, having set therein a condensing coil and a plurality of coil-shaped water pipes. The condensing coil is uniformly arranged around the inner wall surface of the housing, having an inlet at one end connected to the expansion valve of the water cooler and an outlet at an opposite end connected to the compressor of the water cooler for circulation of cooling medium. The coil-shaped water pipes are separately mounted in the housing, having each two opposite ends respectively connected to an independent inlet valve and an independent outlet valve mounted on the housing at the outside. A plurality of reservoirs are separately connected to the inlet and outlet valves of each coil-shaped water pipes so that the liquid from each reservoir can be separately pumped into the coil-shaped water pipes for circulation through the cooling tank for cooling.

DETAILED DESCRIPTION OF THE PREFERRED EMBODIMENT

Figure 1:
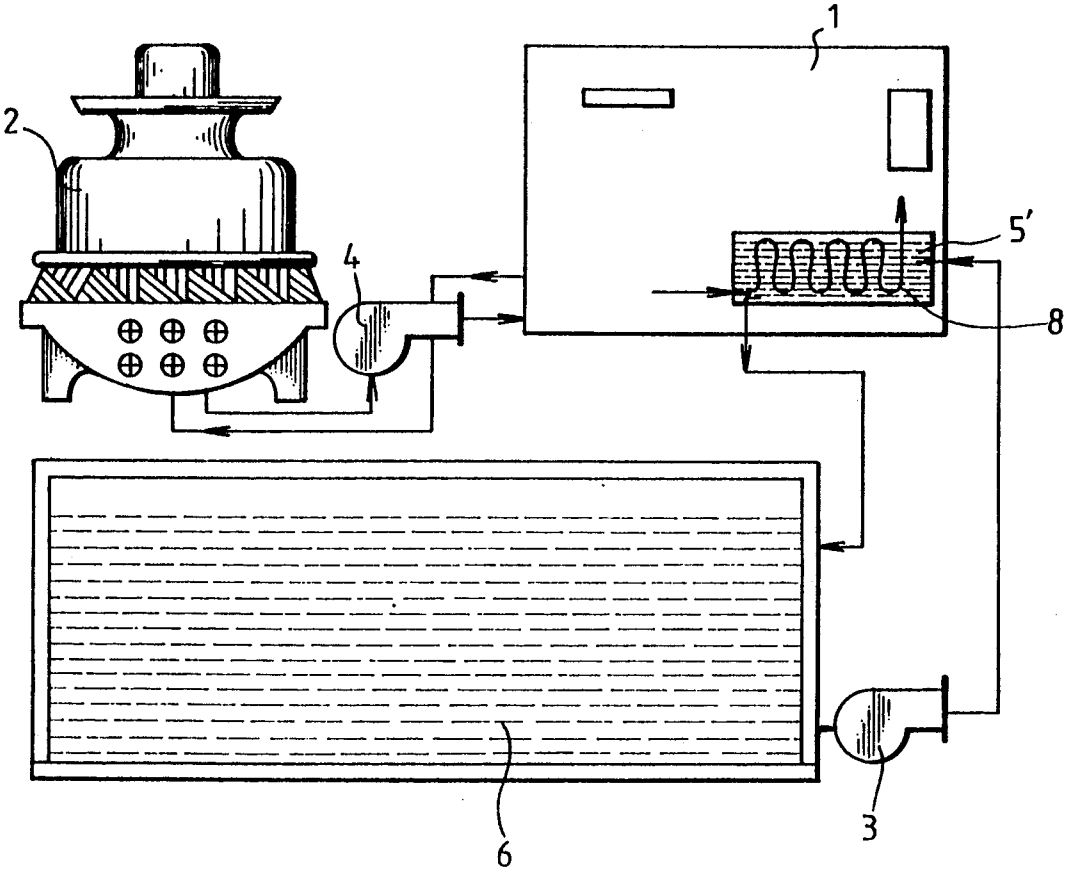
FIG. 1 illustrates a water cooling system according to the prior art.
Figure 2:
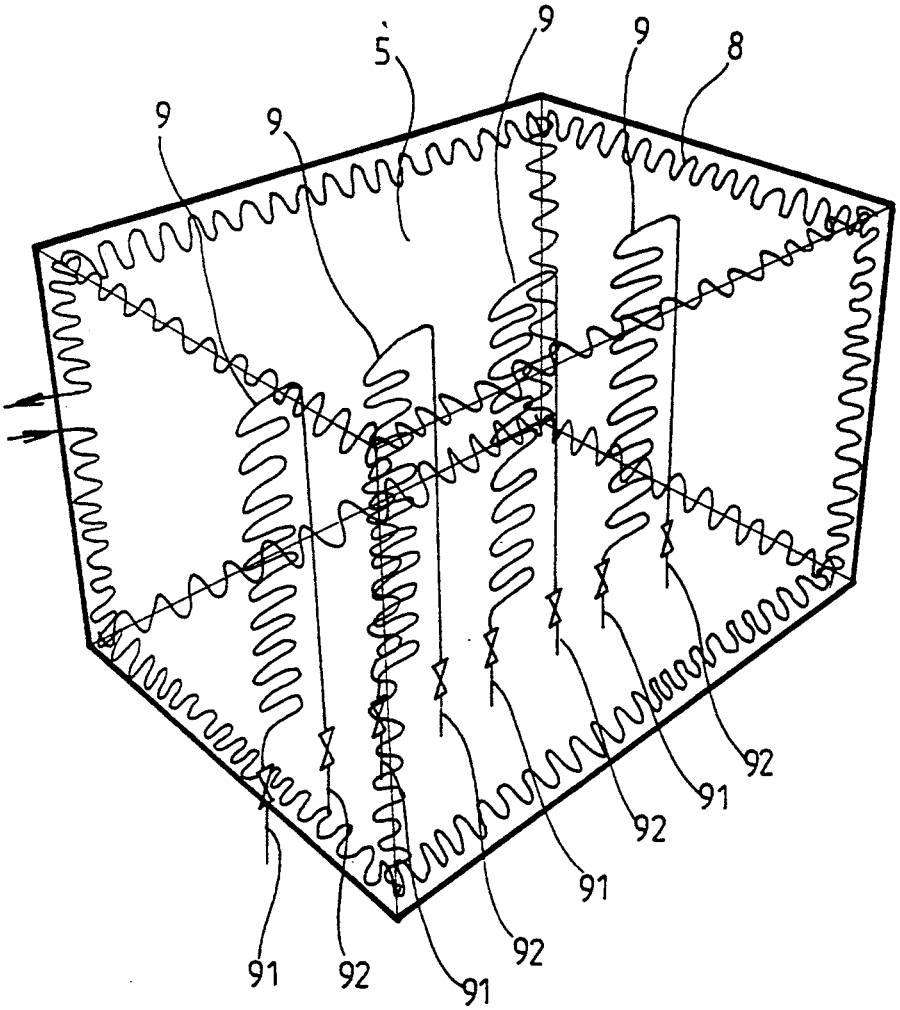
FIG. 2 is a perspective view of a water cooling tank embodying the present invention.
Figure 3:
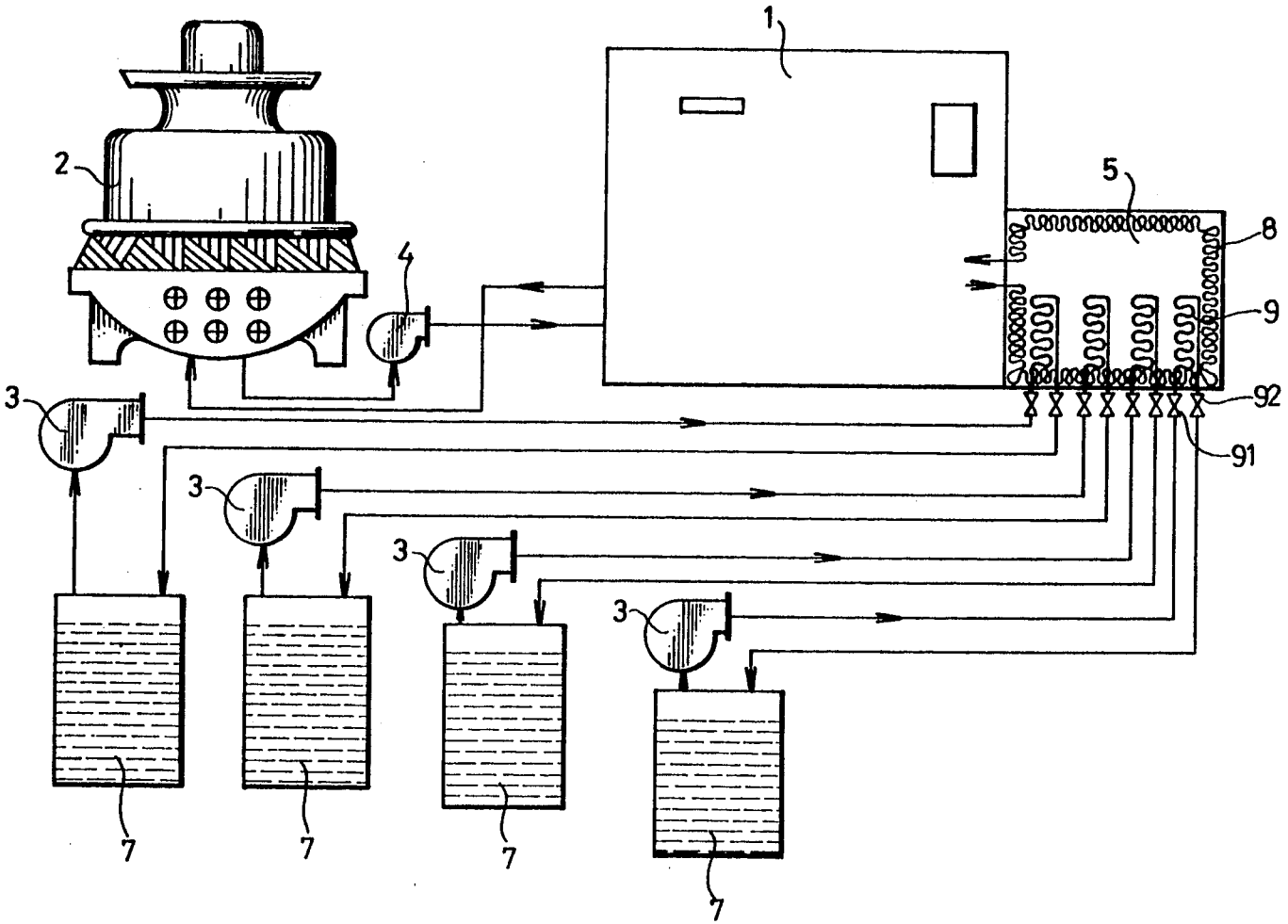
FIG. 3 illustrates a water cooling system constructed according to the present invention.

Referring to FIGS. 2 and 3, a water cooling tank 5 which is provided for holding the cooling water which is pumped from a cooling water tower 2 by a water pump 4 comprises a condensing coil 8 uniformly arranged around the inner wall surface thereof for circulation of cooling medium, for examples, the freon. A plurality of coils 9 are arranged inside the water cooling tank 5 for circulation therethrough of liquid from separate reservoirs permitting said liquid to be separately cooled down by the cooling water kept in the water cooling tank 5. Each coil 9 has two opposite ends respectively connected to an independent inlet valve 91 and an independent outlet valve 92, which inlet and outlet valves 91 and 92 are mounted on the housing of the water cooling tank 5 and respectively connected to an independent chemical liquid reservoir 7 which has a water pump 3 attached thereto to pump the chemical liquid contained therein for circulation through the coil 9 permitting the chemical liquid to be cooled down by the cooling water contained in the water cooling tank 5.

When in use, a user can connect the water cooling tank 5 to a water reservoir 6 or plurality of chemical liquid reservoirs 7, which water reservoir 6 can be used for fish farming. When in operation, the cooling medium in the water cooler 1 is circulating through the condensing coil 8 in the cooling tank 5 to absorb the heat from the water kept in the cooling tank 5 so as to drop the temperature of the water. The chemical liquid from each chemical liquid reservoir 7 or the water from the water reservoir 6 is separately pumped into the coils 9 by a water pump 3 for circulation through the cooling tank 5. While passing through the cooling tank 5, the heat of the water from the water reservoir 6 or the chemical liquid from the chemical liquid reservoirs 7 is simultaneously absorbed by the cooling water in the cooling tank 5. Because the coils 9 have each an independent inlet valve 91 and outlet valve 92, the coils can be separately alternatively controlled for cooling down the chemical liquid from the chemical liquid reservoirs 7 according to requirements.

What is claimed is:

1. For a water cooler, a cooling tank comprising:

a housing for holding water;

a condensing coil uniformly arranged around the inner wall surface of said housing, having an inlet at one end connected to an expansion valve of said water cooler and an outlet at an opposite end connected to a compressor of said water cooler for circulation of cooling medium;

a plurality of coil-shaped water pipes separately mounted in said housing, having each two opposite ends respectively connected to respective inlet valves and outlet valves mounted on said housing at the outside; and wherein a plurality of reservoirs can be respectively connected to the inlet and outlet valves of said coil-shaped water pipes permitting the liquid from each of said reservoirs to be separately pumped into said coil-shaped water pipes for circulation through said cooling tank for cooling.

* * * * *